US008926046B2

(12) United States Patent
Saitou et al.

(10) Patent No.: US 8,926,046 B2
(45) Date of Patent: Jan. 6, 2015

(54) IMAGE FORMING APPARATUS

(71) Applicant: Riso Kagaku Corporation, Tokyo (JP)

(72) Inventors: Mamoru Saitou, Ibaraki (JP); Takashi Ebisawa, Ibaraki (JP); Ryo Terakado, Ibaraki (JP); Toshihide Maesaka, Ibaraki (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 14/024,994

(22) Filed: Sep. 12, 2013

(65) Prior Publication Data

US 2014/0078204 A1 Mar. 20, 2014

(30) Foreign Application Priority Data

Sep. 20, 2012 (JP) ..... 2012-207235

(51) Int. Cl.
*B41J 2/045* (2006.01)
*B41J 2/155* (2006.01)
*B41J 25/308* (2006.01)

(52) U.S. Cl.
CPC ..... *B41J 2/04573* (2013.01); *B41J 2/155* (2013.01); *B41J 25/308* (2013.01); *B41J 2202/20* (2013.01)
USPC ..... 347/14; 347/15; 347/19

(58) Field of Classification Search
CPC .... B41J 29/38; B41J 2/04526; B41J 2/04505; B41J 2/04508; B41J 2/04561; B41J 2/2135; B41J 2/04573; B41J 2/2132; B41J 2/45
USPC ..... 347/8, 14–16, 19, 37, 41, 43, 77–82
See application file for complete search history.

(56) References Cited

U.S. PATENT DOCUMENTS 8,708,444 B2 * 4/2014 Shimizu ..... 347/13

FOREIGN PATENT DOCUMENTS

JP 2010-173178 8/2010

* cited by examiner

*Primary Examiner* — Thinh Nguyen
(74) *Attorney, Agent, or Firm* — Hamre, Schumann, Mueller & Larson, P.C.

(57) ABSTRACT

An image forming apparatus includes at least one inkjet head which is disposed above a feed path of a print medium and on which plural nozzles are aligned along a primary sweeping direction perpendicular to a feed direction of the print medium fed along the feed path. The image forming apparatus forms images by ejecting ink droplets from the nozzles. The image forming apparatus includes a controller that is operable to compensate ejection timings of ink droplets to be ejected from the nozzles onto the print medium based on ejection density of the ink droplets. The image forming apparatus can form good images that are not affected by ink dot displacements caused by feed airflow even when the ink dot displacements are affected by self-induced airflow.

5 Claims, 7 Drawing Sheets

IMAGE FORMING APPARATUS

BACKGROUND OF THE INVENTION

1. Technical Field

The present invention relates to an image forming apparatus for forming images on a print medium fed along a feed path by ejecting ink droplets from an inkjet head(s) onto the print medium.

2. Background Arts

In an image forming apparatus for forming images on a print medium fed along a feed path by ejecting ink droplets from nozzles of inkjet heads onto the print medium, an ink chamber communicating with the nozzles is provided in each of the inkjet heads. To eject the ink droplets from the nozzles, a volume of the ink chamber is changed (increased/decreased: the ink chamber is inflated and deflated) by a drive signal.

While feeding the print medium toward a print position just beneath the ink heads, airflow is generated from an upstream to a downstream along the feed path. In addition, in a case where the print medium is suctioned onto a feed belt by a negative pressure for high-speed feeding, other airflow is also generated beneath the inkjet heads by the negative pressure.

According to such a non-contacting printing method by ejecting ink droplets from nozzles onto a print medium, the ink droplets are drifted downstream along the feed direction by such airflows (hereinafter, referred as feed airflow). Therefore, the ink droplets are deviated from its desired trajectory and landed onto positions other than their target positions. As a result, image degradation may occur due to irregularity of print density (e.g. occurrence of white/black lines, coloration changes of color images and so on).

A Japanese Patent Application Laid-Open No. 2010-173178 (Patent Document 1) discloses a printer (a droplet ejector) that may address the above problems. In the printer, while feeding a print medium, relatively to inkjet heads provided with nozzles, along a direction perpendicular to an alignment direction of the nozzles and ejecting ink droplets, an ejection speed of an ink droplet is made higher as a volume of the ink droplet becomes smaller. According to this ejection speed control, ink dot displacements caused by the feed airflow are restricted.

SUMMARY OF THE INVENTION

However, ink droplets ejected from nozzles of inkjet heads may induce airflow by themselves (hereinafter, referred as self-induced airflow). The self-induced airflow flows downward along an ejection direction of the ink droplets ejected from the nozzles.

The self-induced airflow may assist the ink droplets to go straight. If the self-induced airflow is strong enough, the above-explained ink dot displacements caused by the feed airflow are affected by the self-induced airflow. Namely, the self-induced airflow may spoil effects by the above-explained ejection speed control for restricting the ink dot displacements.

An object of the present invention is to provide an image forming apparatus that can form good images that are not affected by ink dot displacements caused by feed airflow even when the ink dot displacements are affected by self-induced airflow.

An aspect of the present invention provides an image forming apparatus that includes at least one inkjet head which is disposed above a feed path of a print medium and on which a plurality of nozzles are aligned along a primary sweeping direction perpendicular to a feed direction of the print medium fed along the feed path to form images by ejecting ink droplets from the nozzles, and comprises a controller operable to compensate ejection timings of ink droplets to be ejected from the nozzles onto the print medium based on ejection density of the ink droplets.

The ejection density affects self-induced airflow. Therefore, according to the above aspect, even when the self-induced airflow affects ink dot displacements caused by the feed airflow, the affection by the self-induced airflow can be cancelled by compensating the ejection timings in addition to the compensation of the ejection timing for the ink dot displacements caused by the feed airflow. As a result, good images without irregularity of print density can be formed.

Namely, a degree of the self-induced airflow flowing along an ejection direction of the ink droplets between the inkjet head and the print medium (feed path) becomes larger as the ejection density becomes larger. When the degree of the self-induced airflow becomes larger, the ink dot displacements to a downstream of the feed airflow are made smaller. Therefore, by considering the degree of the self-induced airflow in addition to the ink dot displacements caused by the feed airflow, the controller can compensate the ejection timings for preventing the ink dot displacements precisely.

It is preferable that the controller is operable to determine compensation content by additionally considering irregularity of print density of the images formed on the print medium, and to compensate the ejection timings further based on the compensation content for each of the nozzles.

According to this configuration, the controller can compensate the ejection timings for preventing the ink dot displacements more precisely by considering the irregularity of print density of the images formed on the print medium in addition to the ink dot displacements caused by the feed airflow and the degree of the self-induced airflow.

It is preferable that the ejection density is determined based on at least one of the number of nozzles aligned continuously along the primary sweeping direction that are to eject ink droplets and the number of lines aligned parallel in the feed direction onto which a single nozzle is to eject ink droplets continuously.

As the number of nozzles (that are to eject ink droplets) aligned continuously along the primary sweeping direction becomes larger, the self-induced airflow becomes wider in the primary sweeping direction. As the number of lines (onto which a single nozzle is to eject ink droplets continuously) aligned parallel in the feed direction becomes larger, ejection intervals from the single nozzle become shorter. In these cases, the degree of the self-induced airflow becomes larger, so that the ink dot displacements caused by the feed airflow are made smaller. Therefore, according to this configuration, the controller can compensate the ejection timings for preventing the ink dot displacements more precisely by determining the ejection density based on at least one of the number of nozzles and the number of lines.

Here, it is more preferable that the ejection density is determined based on the number of ink droplets to be ejected from one of the nozzles aligned continuously or the single nozzle to an identical landing position on the print medium.

As the number of ink droplets to be ejected from one of the nozzles aligned continuously or the single nozzle to an identical landing position on the print medium becomes larger, the self-induced airflow last longer and the degree of the self-induced airflow becomes larger. Therefore, the ink dot displacements caused by the feed airflow are made smaller. According to this configuration, the controller can compensate the ejection timings for preventing the ink dot displacements more precisely by determining the ejection density further based on the number of ink droplets in addition to based on at least one of the number of nozzles and the number of lines.

It is preferable that the image forming apparatus further includes a head gap adjustment unit that adjusts a head gap between a ejection surface of the inkjet head and a medium hold surface of a feed belt for feeding the print medium, and the controller is operable to determine compensation content by additionally considering the head gap adjusted by the head gap adjustment unit, and to compensate the ejection timings further based on the compensation content for each of the nozzles.

As the head gap becomes wider, the ink dot displacements caused by the feed airflow become larger. Therefore, according to this configuration, the controller can compensate the ejection timings for preventing the ink dot displacements more precisely by additionally considering the head gap adjusted by the head gap adjustment unit.

It is preferable that the controller is operable to determine compensation content by additionally considering a feed speed of the print medium, and to compensate the ejection timings further based on the compensation content for each of the nozzles.

As the feed speed of the print medium head gap becomes higher, the ink dot displacements caused by the feed airflow become larger. Therefore, according to this configuration, the controller can compensate the ejection timings for preventing the ink dot displacements more precisely by additionally considering a feed speed of the print medium.

DESCRIPTION OF THE EMBODIMENTS

Figure 1:
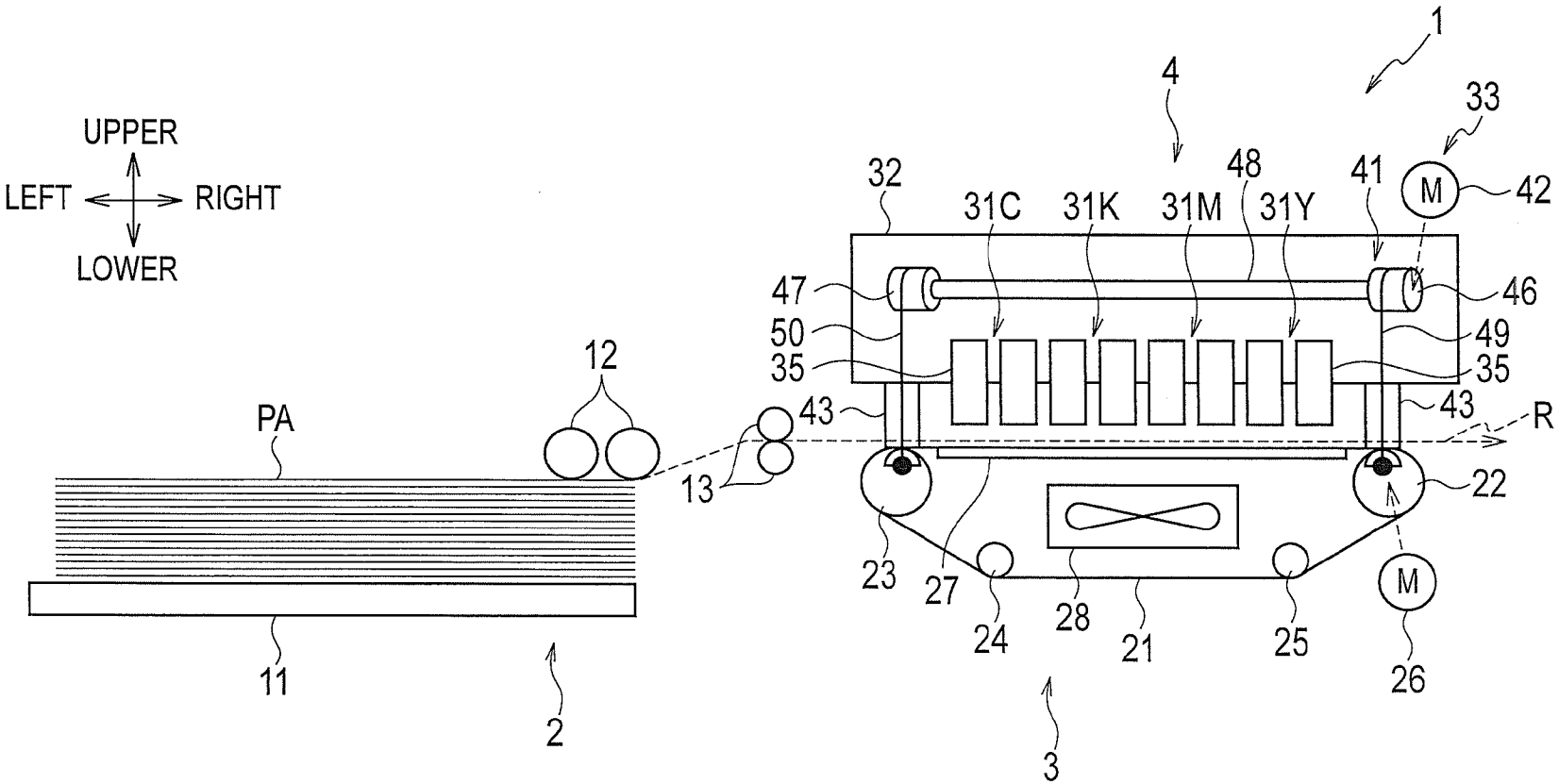
FIG. 1 is a schematic side view of an image forming apparatus according to an embodiment.

Hereinafter, an embodiment will be explained with reference to the drawings. In the drawings, an identical or equivalent component is indicated by an identical reference number. Note that the drawings show components schematically, and it should be considered that the components in the drawings are not shown precisely as they are. In addition, actual dimensions of the components and actual dimensional proportions among the components may be shown differently in the drawings.

Further, the embodiment described below is explained as an example that specifically carries out the subject matter of the present invention. In addition, materials, shapes, structures, arrangements of the components are not limited to those in the embodiment. The embodiment may be modified within the scope of the claims (e.g. arrangement of the components may be changed from the embodiment).

Figure 4:
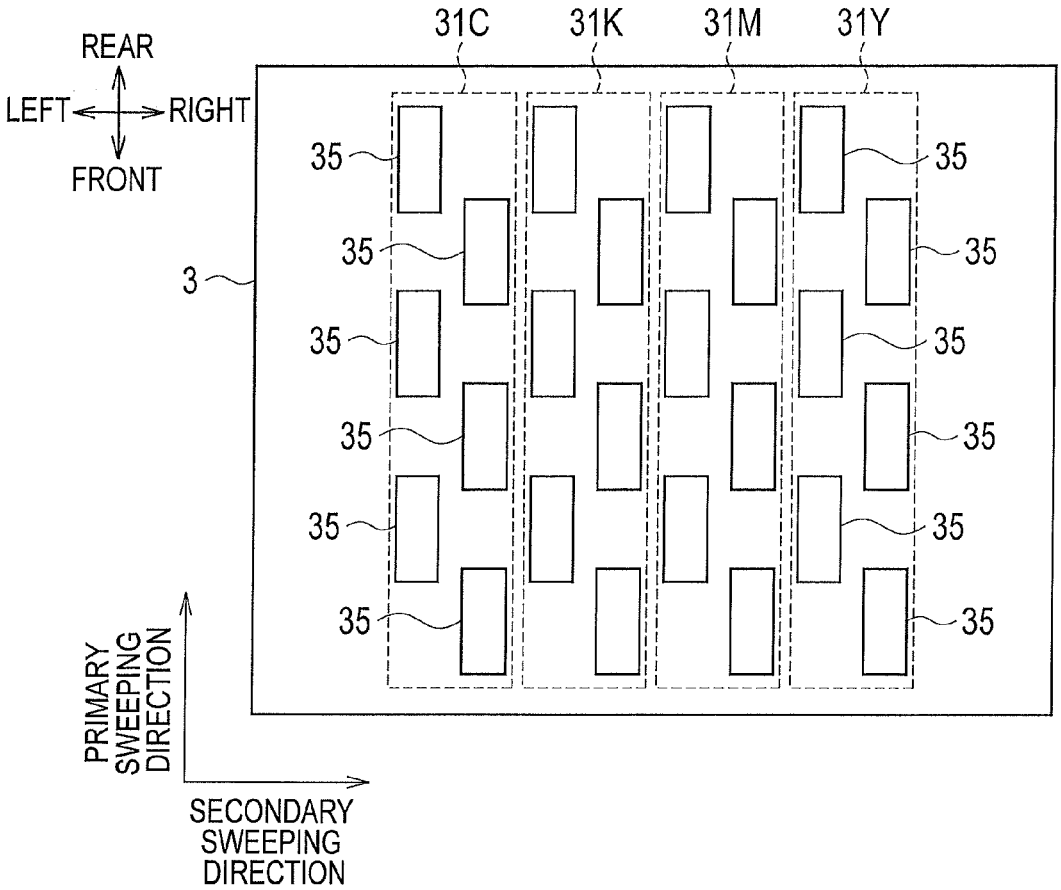
FIG. 4 is a plan view showing arrangement of head blocks in the image forming apparatus.

In the following explanations, terms "front (forward)", "rear (backward)", "left", "right", "upper" and "lower" are used as shown in FIGS. 1 and 4. In addition, terms "upstream" and "downstream" are used in relation to a feed flow of print sheets (served as print media) PA. The print sheets PA are fed along a feed path R shown by a dotted line in FIG. 1.

Figure 2:
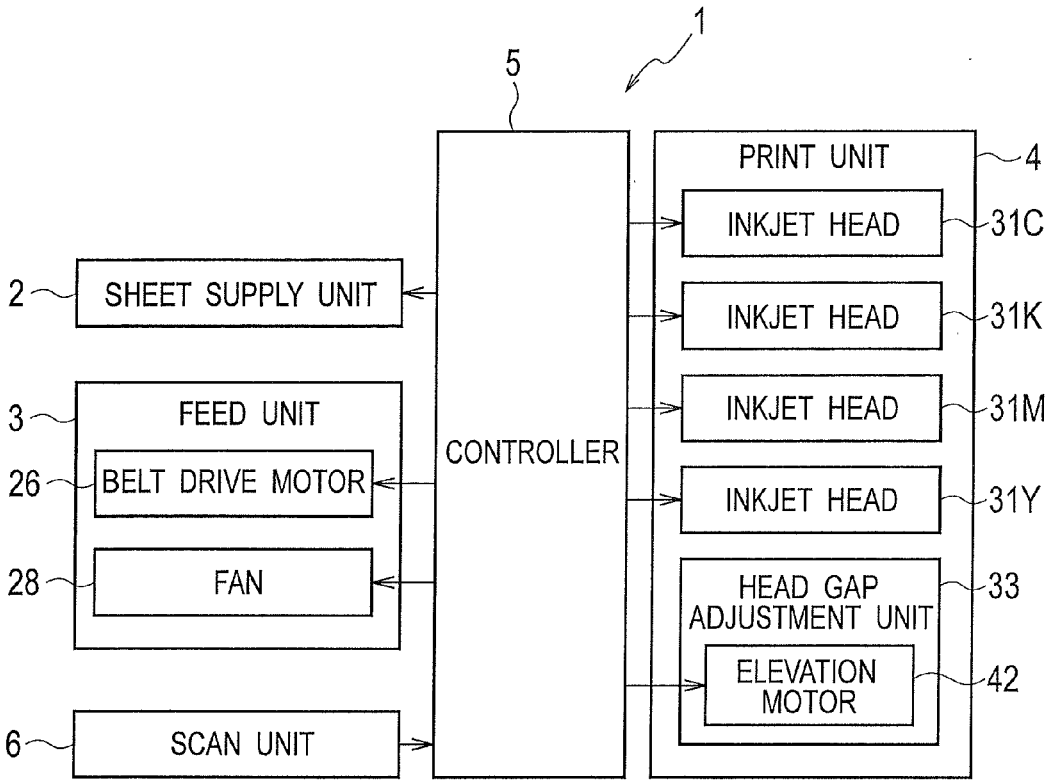
FIG. 2 is a block diagram of the image forming apparatus.

As shown in FIGS. 1 and 2, an inkjet printer (served as an image forming apparatus) 1 includes a sheet supply unit 2, a feed unit 3, a print unit 4, a controller 5, and a scan unit 6.

The sheet supply unit 2 supplies print sheets PA sequentially. The sheet supply unit 2 includes a sheet tray 11, a pair of sheet supply rollers 12, and a pair of registration rollers 13. The print sheets PA to be printed are stacked on the sheet tray 11.

The pair of sheet supply rollers 12 picks up the print sheets PA stacked on the sheet tray 11 sheet by sheet, and then sequentially feeds them to the pair of registration rollers 13. The pair of sheet supply rollers 12 is disposed above the sheet tray 11, and driven by a sheet supply motor (not shown).

The pair of registration rollers 13 temporally holds the print sheet PA fed by the pair of sheet supply rollers 12 at its registration nip, and then feed it toward the feed unit 3. The pair of registration rollers 13 is disposed on a downstream side of the pair of sheet supply rollers 12, and driven by a registration motor (not shown).

The feed unit 3 feeds the print sheet(s) PA fed from the pair of registration rollers 13 forward. The feed unit 3 includes a feed belt 21, a driving roller 22, driven rollers 23 to 25, a belt drive motor 26, a platen plate 27, and a fan 28.

Figure 3:
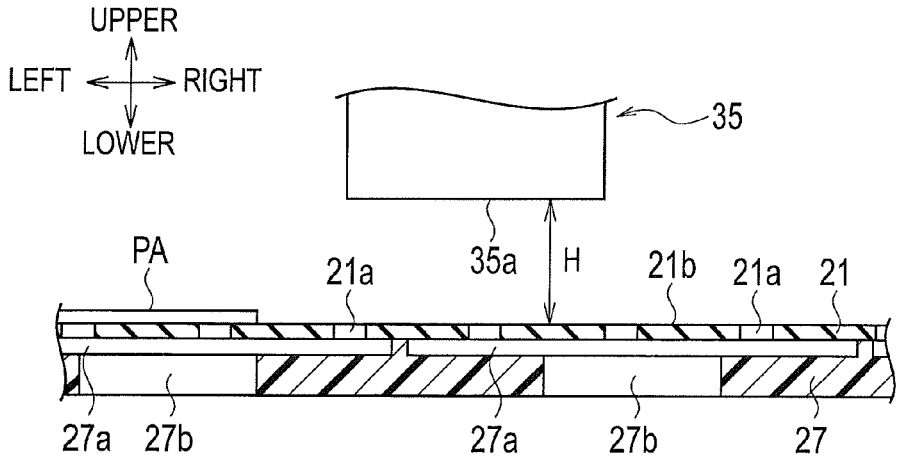
FIG. 3 is an enlarged cross-sectional side view of a platen plate in the image forming apparatus.

The feed belt 21 is an endless belt wound around the driving roller 22 and the driven rollers 23 to 25. As shown in FIG. 3, a large number of belt holes 21*a* for suctioning the print sheet PA are formed on the feed belt 21. The print sheet PA is suctioned onto a sheet hold surface (served as a medium hold surface) 21*b* of the feed belt 21 by a suction force generated by the fan 28 and applied to the print sheet PA through the belt holes 21*a*. The sheet hold surface 21*b* is an upper surface of an almost horizontal segment of the feed belt 21 between the driving roller 22 and the driven roller 23.

The feed belt 21 is rotated clockwise in FIG. 1 by the rotation of the driving roller 22. As a result, the feed belt 21 is rotated endlessly, and thereby the print sheet PA suctioned onto the sheet hold surface 21*b* is fed forward (rightward in FIG. 1).

As explained above, the feed belt 21 is wound around the driving roller 22 and the driven rollers 23 to 25. The belt drive motor 26 drives the driving roller 22, so that the driving roller 22 rotates the feed belt 21. The driven rollers 23 to 25 are passively rotated by the feed belt 21. The driven roller 23 is disposed at the same height level as the height level of the driving roller 22, and distanced from the driving roller 22. The driven rollers 24 and 25 are disposed at a lower level than the height level of the driving roller 22 and the driven roller 23. The driven rollers 24 and 25 are disposed at the same height level, and distanced from each other.

The platen plate 27 is disposed between the driving roller 22 and the driven roller 23, and disposed under the feed belt 21 to support the feed belt 21 slidably from below. As shown in FIG. 3, bottomed holes 27*a* are formed, on the platen plate 27, in areas where the belt holes 21*a* pass over, and a suction hole 27*b* that penetrated the platen plate 27 is formed at each center of the bottomed hole 27*a*. Namely, the suction hole 27*b* penetrates the bottom of the bottomed hole 27*a*.

The fan 28 generates airflow downward. Therefore, the fan 28 suctions air through the suction holes 27*b*, the bottomed holes 27*a* and the belt holes 21*a* to generate a negative pressure. The print sheet PA is suctioned onto the sheet hold surface 21*b* by the negative pressure. The fan 28 is disposed below the platen plate 27.

The print unit 4 prints images on the print sheets PA being fed by the feed unit 3. The print unit 4 is disposed above the feed unit 3. The print unit 4 is fixed in a housing body (not shown) of the inkjet printer 1. The print unit 4 includes inkjet heads 31C, 31K, 31M and 31Y, a head holder 32, and a head gap adjustment unit 33. Note that their suffixes (C, M, Y, K) that indicate colors will be omitted when it is not needed to distinguish them.

The inkjet heads 31C, 31K, 31M and 31Y eject cyan (C), black (K), magenta (M) and yellow (Y) ink droplets, respectively. The inkjet heads 31C, 31K, 31M and 31Y are aligned along the secondary sweeping direction (left-right direction) in this order from an upstream. The inkjet heads 31 are line-type inkjet heads, and each of them includes six head blocks 35 as shown in FIG. 4.

In each of the inkjet heads 31, the six head blocks 35 are arranged in a staggered manner. Specifically, in each of the inkjet heads 31, the head blocks 35 are aligned along the primary sweeping direction (front-rear direction), but they are set off alternately in the secondary sweeping direction (left-right direction). The head holder 32 holds the head blocks 35 as shown in FIG. 1. The head holder 32 is formed as a hollow cuboid.

Plural nozzles 38 (see FIG. 6) are formed on each ejection surface 35*a* (bottom face: see FIG. 3) of the head blocks 35. The nozzles 38 are aligned along the primary sweeping direction at even intervals P. The number of ink droplets to be ejected from a single nozzle 38 (the number of drops) can be changed. Gradation printing in which print density is varied by changing the number of drops (e.g. 1 to 7 drops) can be done.

The head gap adjustment unit 33 adjusts a head gap H (see FIG. 3). The head gap H is a distance between the sheet hold surface 21*b* of the feed belt 21 and the ejection surface(s) 35*a* of the head block(s) 35. The head gap adjustment unit 33 includes a pair of gap adjustment mechanisms 41, an elevation motor 42 and connecting members 43.

The pair of gap adjustment mechanisms 41 elevates the feed unit 3 relatively to the inkjet heads 31. Namely, the height level of the inkjet heads 31 is fixed, and the feed unit 3 is elevated by the head gap adjustment unit 33. One of the gap adjustment mechanisms 41 is disposed on a front side and another is disposed on a rear side (FIG. 1 shows only the one on the front side). Each of the gap adjustment mechanisms 41 includes a pair of pulleys 46 and 47, a shaft 48 and wires 49 and 50. Since the gap adjustment mechanisms 41 have the symmetrical configurations to each other, only one of them will be explained below.

The pulleys 46 and 47 reel off and out the wires 49 and 50, respectively. The pulleys 46 and 47 are distanced from each other along the secondary sweeping direction (left-right direction), and rotatably supported in the head holder 32. The shaft 48 connects the pair of pulleys 46 and 47. The shaft 48 extends along the secondary sweeping direction (left-right direction). The pulley 46 is fixed to one end of the shaft 48, and the pulley 47 is fixed at another end of the shaft 48. Therefore, the pair of pulleys 46 and 47 is rotated synchronously.

The feed unit 3 is suspended by the wires 49 and 50. Ends of the wires 49 and 50 are fixed to the feed unit 3, and other ends of the wires 49 and 50 are wound around the pulleys 46 and 47, respectively. The feed unit 3 is elevated up and down when the wires 49 and 50 are reel off and out by rotations of the pulleys 46 and 47, and thereby the head gap H is adjusted.

The elevation motor 42 rotates the pulleys 46 and 47 and the shaft 48. The connecting members 43 connect the feed unit 3 with the head holder 32. Each of the connecting members 43 is configured to adjust its length according to the head gap H.

The scan unit 6 has a feed device for feeding originals forward and a scanning device for scanning images on the original (the devises are not shown). The scan unit 6 scans the images by the scanning device while feeding the originals set on a tray of the feed device, and thereby converts the scanned images into image data.

Figure 5:
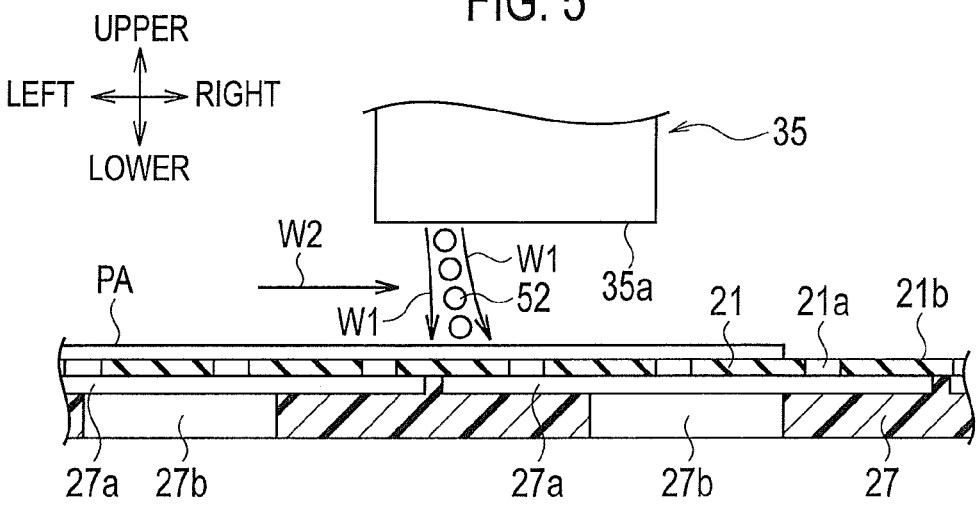
FIG. 5 is an enlarged cross-sectional side view showing self-induced airflow.

During printing by the inkjet printer 1 according to the present embodiment, as shown in FIG. 5, self-induced airflow W1 is generated from the head block 35 toward the print sheet PA when ink droplets 52 are ejected from the head block 35 of the inkjet head 31. In addition, feed airflow W2 flowing along the feed direction is also generated when the feed unit 3 feeds the print sheet PA and air is suctioned by the fan 28.

The ink droplets 52 are drifted downstream in the feed direction by the feed airflow W2, so that ink dots are displaced from their target position. On the other hand, the self-induced airflow W1 assists the ink droplets 52 to go straight toward the print sheet PA, and reduces the ink dot displacements of the ink droplets 52 to the downstream in the feed direction caused by the feed airflow W2.

The self-induced airflow W1 becomes strong when the plural nozzles 38 aligned along the primary sweeping direction eject ink droplets. In addition, the self-induced airflow W1 also becomes strong when a single nozzle 38 continuously ejects ink droplets onto lines aligned parallel in the feed direction. Further, the self-induced airflow W1 also becomes strong when a single nozzle 38 continuously ejects ink droplets to a single dot.

Here, density of ink droplets ejected from nozzles 38 to form dots per unit area on the print sheet PA is referred as "ejection density". Namely, the self-induced airflow W1 induced by ejections of the ink droplets becomes strong when an area where the ejection density is high exists. Hereinafter, the area where the ejection density is high is referred as an ejection high-density area. Therefore, degree of the self-induced airflow W1 affects the ink dot displacements of the ink droplets 52 to the downstream in the feed direction of the print sheet PA caused by the feed airflow W2. Note that the "ejection density" may be also referred as "dot density" in view of dots formed by ejected ink droplets.

In the present embodiment, the ejection density is determined based on at least one of (1) the number of nozzles 38 (that are to eject ink droplets) aligned continuously along the primary sweeping direction and (2) the number of lines (onto which a single nozzle 38 is to eject ink droplets continuously) aligned parallel in the feed direction. In the case (1), as the number of nozzles 38 becomes large, a width of the self-induced airflow becomes wider in the primary sweeping direction. In the case (2), as the number of lines becomes large, ejection intervals from the single nozzle 38 become shorter. In these cases, the degree of the self-induced airflow becomes larger, so that the ink dot displacements caused by the feed airflow are made smaller. By determining the ejection density based on at least one of (1) the number of nozzles and (2) the number of lines, the ink dot displacements can be restricted effectively.

Here, it is preferable that the ejection density is determined based on the number of ink droplets to be ejected from (1) one of the nozzles 38 aligned continuously or (2) the single nozzle 38 to an identical landing position (a single dot) on the print medium. In the case (1), as the number of ink droplets to be ejected from one of the continuously-aligned nozzles 38 becomes larger, the self-induced airflow last longer and the degree of the self-induced airflow becomes larger. Also in the case (2), as the number of ink droplets to be ejected from the single nozzle 38 to an identical landing position on the print medium becomes larger, the self-induced airflow last longer and the degree of the self-induced airflow becomes larger. Therefore, the ink dot displacements caused by the feed airflow are made smaller. By determining the ejection density further based on the number of ink droplets to be ejected continuously in addition to based on at least one of (1) the number of nozzles 38 and (2) the number of lines, the ink dot displacements can be restricted more effectively.

Figure 6:
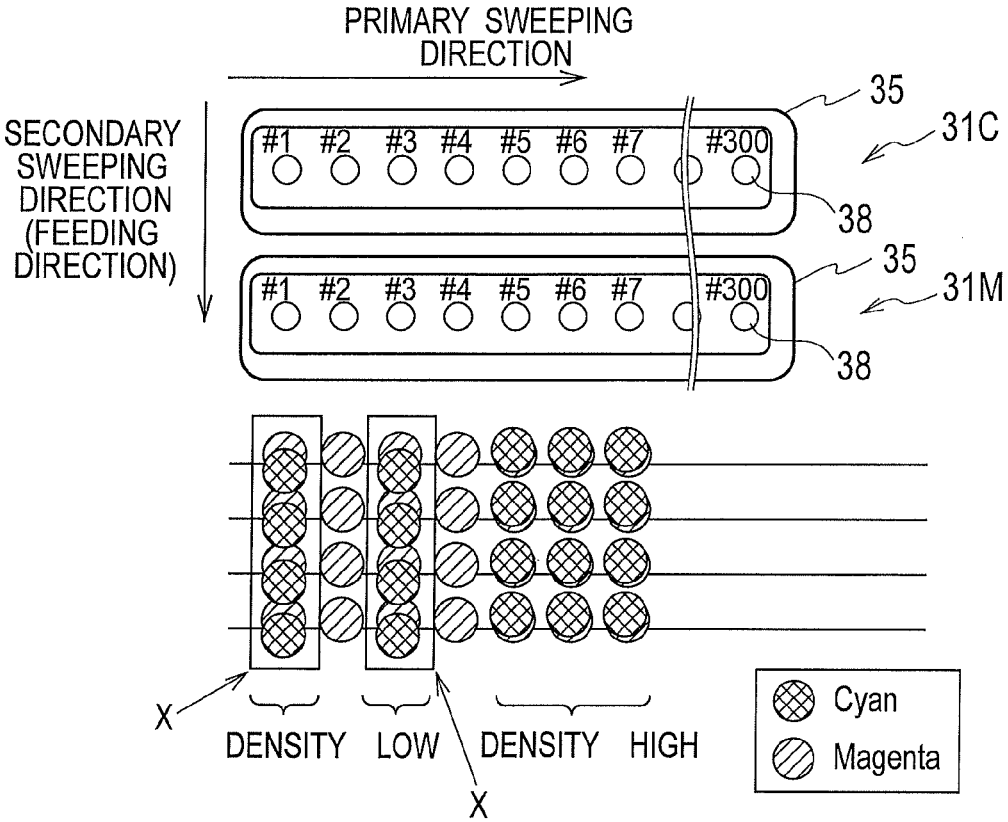
FIG. 6 is a plan view showing ink dot displacements.

For example, FIG. 6 shows a case where ink droplets are ejected from nozzles 38 of the cyan (C) and magenta (M) head blocks 35 to identical dots on the print sheet PA, respectively. Cyan (C) ink droplets and magenta (M) ink droplets are ejected from #5 to #7 of the nozzles 38 onto dots by identical ejection densities, respectively, so that ink dots aren't displaced between the colors. However, cyan (C) ink droplets are ejected from #1 to #4 of the nozzles 38 by lower ejection density than ejection density for magenta (M) ink droplets ejected from #1 to #4 of the nozzles 38. Therefore, the cyan (C) ink droplets ejected by the lower ejection density is drifted downstream in the feed direction by the feed airflow W2. As a result, cyan (C) ink dots are displaced downstream in the secondary sweeping direction (feed direction) relative to magenta (M) ink dots (see portions X in FIG. 6). These ink dot displacements cause irregularity of print density.

Note that FIG. 6 shows the case where the ejection densities of cyan (C) and magenta (M) inks are different from each other along the secondary sweeping direction (feeding direction). However, the same result will be brought also in a case where the ejection densities are different along the primary sweeping direction and in a case where an ejection density for each dot is differentiated from others.

If a situation shown in FIG. 6 occurs, ejection timings of the cyan (C) ink droplets ejected by the lower ejection density made relatively earlier than ejection timings of the magenta (M) ink droplets. By this control, the ink dot displacement of the cyan (C) ink droplets relative to dots made by the magenta (M) ink droplets can be restricted.

Therefore, the controller 5 shown in FIG. 2 preliminarily stores a compensation table in order to adjust the ejection timings of the ink droplets 52 to be ejected from the nozzles 38 to the above-explained ejection high-density ejection area according to the degree of the self-induced airflow W1.

In the compensation table, adjustment values for compensated ejection timings to reference ejection timings are regulated according to the ejection density that affects the above-explained degree of the self-induced airflow W1 in consideration of changes of the ink dot displacements caused by the feed airflow W2 according to the degree of the self-induced airflow W1 (the ink dot displacements becomes smaller when the degree of the self-induced airflow W1 becomes larger, and the ink dot displacements becomes larger when the degree of the self-induced airflow W1 becomes smaller). Note that the reference ejection timings are made for a condition where no feed airflow is generated.

Here, the ejection density can be presented by the coverage rate that indicates a ratio of an actually printed area to a printable area on the print sheet PA, for example.

The coverage rate can be defined one-dimensionally or two-dimensionally by one or both of the number of ink droplets continuously ejected along the primary sweeping direction and the number of ink droplets continuously ejected along the secondary sweeping direction.

The controller 5 in the present embodiment uses the compensation table in which the adjustment values for the compensated ejection timings to the reference ejection timings sectionally-regulated according to the coverage rate defined two-dimensionally by the both of the number of ink droplets continuously ejected along the primary sweeping direction and the number of ink droplets continuously ejected along the secondary sweeping direction.

The ejection density (coverage rate) may include consideration of the number of ink droplets to be ejected onto a single dot by a single nozzle 38, and the adjustment values to the reference ejection timings may be sectionalized according to the ejection density (coverage rate) including the consideration of the number of ink droplets to be ejected onto a single dot by a single nozzle 38.

In the inkjet printer 1 explained above, cyan (C), black (K), magenta (M) and yellow (Y) ink droplets are ejected from the nozzles 38 on the head blocks 35 of the inkjet heads 31C, 31K, 31M and 31Y. Therefore, the controller 5 individually controls the adjustments of the ejection timings using the compensation table for each of the nozzles 38.

Note that, for example, when determining, for each ejection by a nozzle 38, a compensation content to be applied to the nozzle 38 using the compensation table according to the coverage rate, the coverage rate for the nozzle 38 is determined as follows.

Specifically, in each of the head blocks 35, the coverage rate may be determined based on ejection patterns (ejections along the primary sweeping direction, ejections along the secondary sweeping direction, and/or ejections onto a single dot) of ink droplets ejected onto dots on predetermined past lines (e.g. past 30 lines) by a compensation-target nozzle 38 and nozzles 38 adjacent to the compensation-target nozzle 38 along the primary sweeping direction. Of course, further nozzles 38 along the primary sweeping direction may be taken into account for referring the ejection patterns to determine the coverage rate.

In addition, the specific compensation content according to the coverage rate is determined based on the ink dot displacements along the secondary sweeping direction due to the self-induced airflow W1 empirically obtained based on test patterns printed by the inkjet printer 1 for every coverage rate (ejection density), for example.

Note that, in the present embodiment, the compensation content according to the coverage rate is determined for each of the nozzles 38. Therefore, it is preferable that the above-mentioned test patterns printed by the inkjet printer 1 include a lot of patterns requiring that all the nozzles 38 eject ink droplets with different coverage rates (ejection densities) for the primary and secondary sweeping directions.

In addition, since the number of ink droplets ejected into a single dot by a single nozzle 38 is considered for the coverage rate (ejection density) in the present embodiment, it is preferable that the above-mentioned test patterns include patterns differentiating the number of ink droplets ejected into a single dot by a single nozzle 38.

Figure 7:
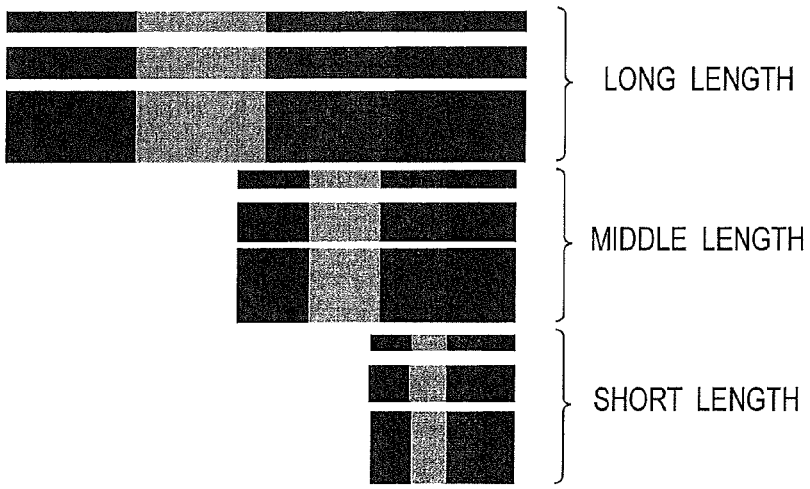
FIG. 7 is a plan view of test patterns used when determining compensation contents for a compensation table.

Here, test patterns shown in FIG. 7 may be used. In the test patterns, there are three groups in which the number of continuously ejected ink droplets from the nozzles 38 along the primary sweeping direction is differentiated in three patterns (large, middle, and small) as shown by "long length", "middle length" and "short length" in FIG. 7. In addition, in each of the groups, there are three patterns in which the number of continuously ejected ink droplets from the nozzles 38 along the secondary sweeping direction is differentiated in three patterns (large, middle, and small) as shown by differences of vertical width (narrow, middle, and wide: in this order from the upper side) in each of the group in FIG. 7. Further, in each of the patterns, there are four areas in which the number of ink droplets ejected to a single dot is differentiated in four patterns (large, small, middle, large: in this order from the left side) as shown by density graduations in FIG. 7.

As a result, the compensation contents can be determined based on the ink dot displacements along the secondary sweeping direction due to the self-induced airflow W1 obtained for every coverage rate by using the above-explained test patterns in which the two-dimensional coverage rate (ejection density) considering the both of the primary and secondary sweeping directions is improved by further considering the number of ink droplets ejected to a single dot.

Next, processes for determining the compensation contents for the compensation table stored in a hard disk drive, for example, of the controller 5 will be explained.

Figure 8:
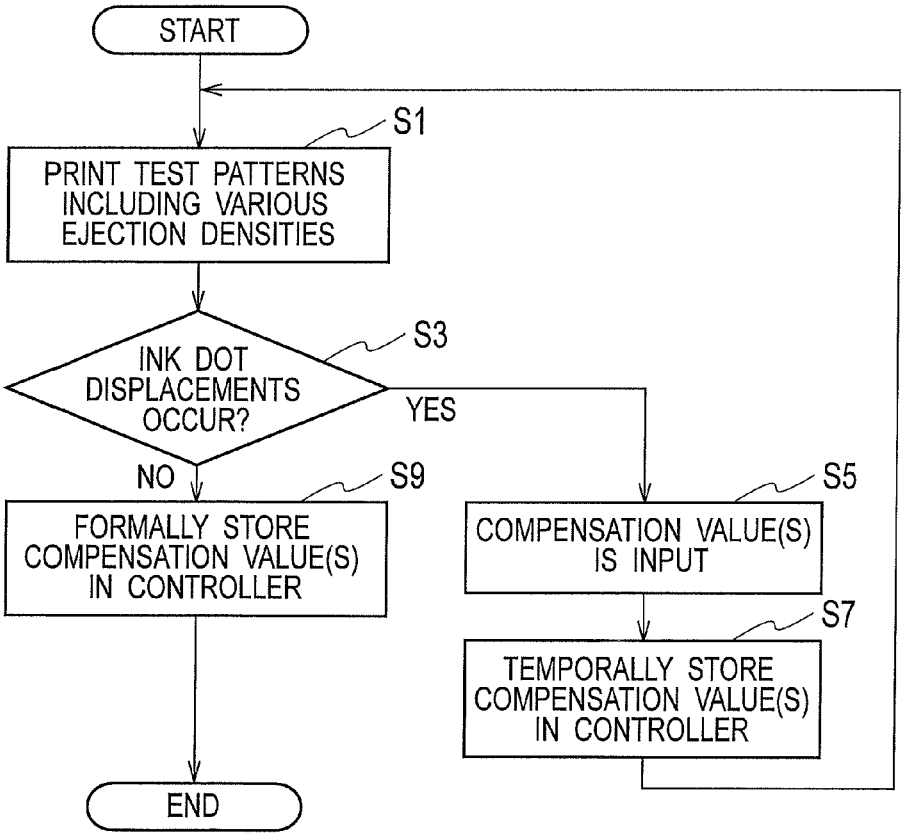
FIG. 8 is a flowchart including processes for determining the compensation contents for the compensation table.

The processes are shown in a flowchart of FIG. 8, and executed when image data of the test patterns shown in FIG. 7 are input to the inkjet printer 1.

The controller 5 retrieves print data of the test patterns shown in FIG. 7 from the hard disk drive, and then prints the test patterns by controlling the print unit 4. Note that the controller 5 uses the compensation table stored the hard disk drive for this printing, and compensates the ejection timings of the ink droplets to be ejected from the nozzles 38 to make them earlier than the reference ejection timings to cancel the ink dot displacements caused by the feed airflow W2 (step S1). Since the ink droplets are to be drifted downstream in the feed direction by the feed airflow W2, the ejection timings are made earlier than the reference ejection timings made for a condition where no feed airflow W2 is generated.

After the test patterns are printed, it is judged whether or not ink dot displacements occur in the test patterns printed on the print sheet PA (step S3).

When the ink dot displacements occur (YES in step S3), a compensation value(s) for compensating the ink dot displacements is input into the inkjet printer 1 by a user's operation through an operation panel (not shown) (step S5). The input compensation value(s) is temporally stored in the hard disk drive of the controller 5 as a compensation value(s) for the ejection timings for every ejection density and every ink color (step S7). After the process in the step S7, the process flow is returned to the step S1.

When no ink dot displacements occur (NO in step S3), a compensation value(s) temporally stored in the hard disk drive of the controller 5 is formally stored in the hard disk drive as a compensation value(s) for the ejection timings for every ejection density and every ink color (step S9). After the process in the step S9, the process flow is ended.

Note that the following processes may be also possible for determining compensation contents. The printed test patterns are scanned by the scan unit 6, and the controller 5 judges whether or not ink dot displacements occur in the test patterns printed on the print sheet PA. The controller 5 updates the compensation value(s) based on the above judgment result. Namely, the controller 5 carries out printing of the test patterns and updating the compensation value(s) repeatedly to determine the compensation contents for the compensation table with no user's input operation.

Subsequently, operations of the inkjet printer 1 for compensating the ejection timings by applying the compensation contents of the compensation table will be explained.

Figure 9:
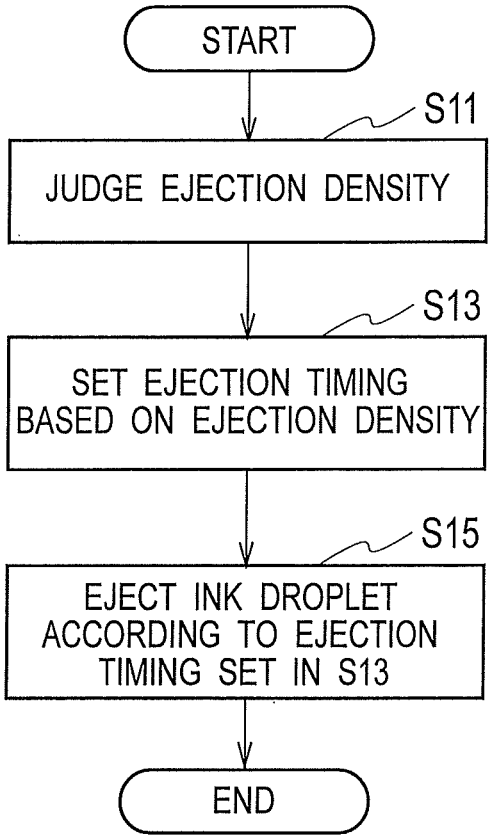
FIG. 9 is a flowchart including processes for operating the image forming apparatus when compensating ejection timings of ink droplets from nozzles to which the compensation contents for the compensation table is applied.

Processes for the operations are shown in a flowchart of FIG. 9, and executed when image data of a print job are input to the inkjet printer 1 and the controller 5 converts the input image data (RGB data) into drop data that are optimized for ejecting ink droplets from the inkjet heads 31.

The controller 5 regards, for every color, a pixel associated with a single nozzle 38 in the drop data as a target pixel, and judges which is the ejection density of the target pixel, large, middle or small based on the drop data for the target pixel and its circumjacent pixels (both sides along the primary sweeping direction and an upstream side along the secondary sweeping direction) (step S11).

Subsequently, the controller 5 retrieves a compensation content from the compensation table according to the ejection density (large, middle or small) judged in the step S11, i.e. according to the coverage rate. Then, the ejection timing of the nozzle 38 for the target pixel is set to the ejection timing determined based on the retrieved compensation content as explained-above (step S13).

Therefore, the controller 5 controls the print unit 4 to eject ink droplets according to the number of drops regulated in the drop data from the nozzle 38 using the ejection timing set in the step S13 (step S15).

When making a propulsive force for ejecting ink droplets larger (making an ejection speed higher), it takes shorter time for each of the ink droplets to land on the print sheet PA. Therefore, landing positions of the ink droplets shift upstream along the secondary sweeping direction. On the other hand, when making a propulsive force for ejecting ink droplets smaller (making an ejection speed lower), it takes longer time for each of the ink droplets to land on the print sheet PA. Therefore, landing positions of the ink droplets shift downstream along the secondary sweeping direction.

When making ejection timings of ink droplets earlier, landing positions of the ink droplets shift upstream along the secondary sweeping direction. On the other hand, when making ejection timings of ink droplets later, landing positions of the ink droplets shift downstream along the secondary sweeping direction. Therefore, even when ink droplets of one color are ejected to a target dot (landing position) according to an ejection density ink droplets of another color are ejected to the same dot (landing position) according to a different ejection density, ink dot displacements between the two colors can be restricted by adjusting the ejection timings to shift the landing positions of the ink droplets for each of the two colors. Although the degree of the self-induced airflow W1 induced by the ink droplets of the one color according to the ejection density may become different from the degree of the self-induced airflow W1 induced by the ink droplets of the other color according to the different ejection density, the ink dot displacements between the two colors can be restricted by adjusting the ejection timings, as explained above. Therefore, even when the degrees of the self-induced airflows W1 are different, good images without irregularity of print density such as coloration changes of color images can be formed by compensating the ejection timings to make landing positions of different-color ink droplets closer (identical) along the secondary sweeping direction.

Note that the ink displacements become larger as a distance between the print sheet PA and the ejection surface 35*a* of the head block 35 is larger. The distance between the print sheet PA and the ejection surface 35*a* is a distance obtained by subtracting a thickness of the print sheet PA from the head gap H. Therefore, in a case where only one type of the print sheets PA (having an identical thickness) is used, the ink displacements become larger as the head gap H becomes larger.

However, in a case where various types of the print sheets PA (having different thicknesses) are mixed, the head gap H is set to a distance optimal for the thickest (or relatively-thick) one. Therefore, the distance between the print sheet PA and the ejection surface 35*a* may become large when a thin print sheet PA is fed through under the ejection surface 35*a*.

Figure 10A:
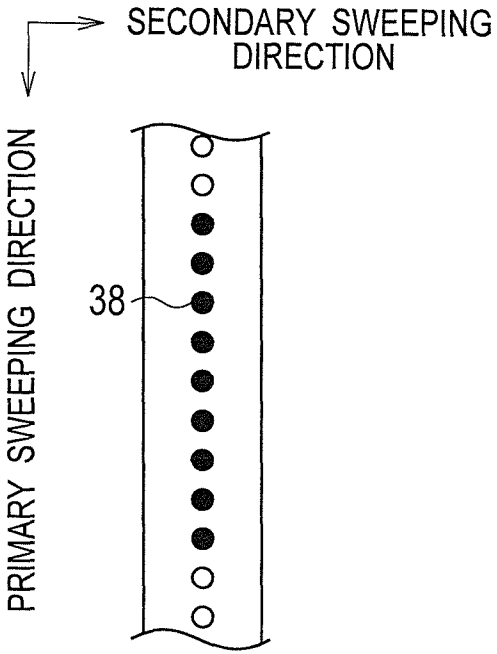
FIG. 10A is a bottom view showing the nozzles.
Figure 10B:
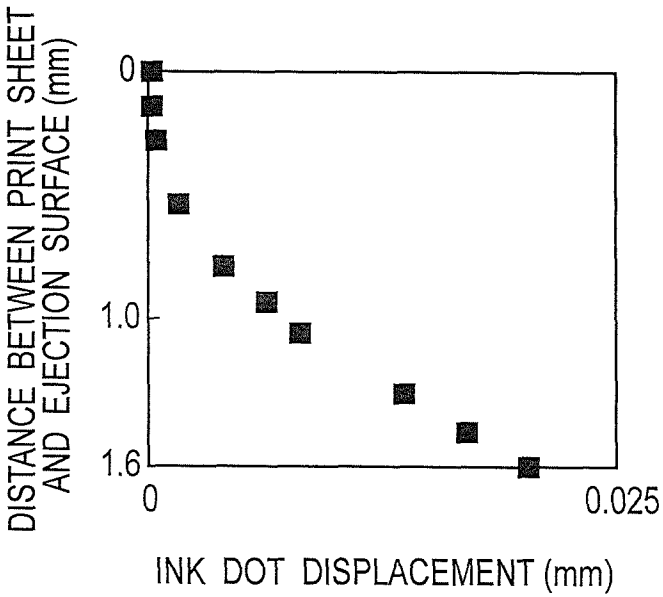
FIG. 10B is a graph showing relations between ink dot displacements along a secondary sweep direction and gaps between a print sheet and an ejection surface.

A graph shown in FIG. 10B shows a relation between the distance between the print sheet PA and the ejection surface 35*a* and the ink dot displacement. The relation is obtained through experiments. Nozzles 38 that ejects ink droplets in the experiments is indicated black circles in FIG. 10A. In FIG. 10B, the ink dot displacement along a horizontal axis is an average of the ink dot displacements by the ink droplets ejected from the nozzles 38. As shown in FIG. 10B, the ink dot displacement becomes larger as the distance between the print sheet PA and the ejection surface 35*a* becomes large.

Therefore, the compensation contents for the ejection timings regulated in the compensation table may be further sectionalized by the head gap H so that the compensation contents (compensation coefficients) are regulated to make the ejection timings earlier as the head gap H becomes larger.

In addition, the feed airflow W2 becomes stronger as its flow speed becomes higher. Since the flow speed of the feed airflow W2 becomes higher as the feed speed of the print sheets PA by the feed unit 3 is made higher, the compensation contents for the ejection timings regulated in the compensation table may be further sectionalized by the feed speed of the by the print sheets PA by the feed unit 3 so that the compensation contents (compensation coefficients) are regulated to make the ejection timings earlier as the feed speed is made higher.

In the above-explained embodiment, explained is a case where the compensation contents for the ejection timings used for canceling irregularity of print density due to the ink dot displacements to the downstream along the secondary sweeping direction caused by the feed airflow W2 are further improved by additionally considering the ink dot displacements along the secondary sweeping direction caused by the self-induced airflow W1. However, the present invention can be broadly applied to a case where the ejection timings are controlled based on the ejection density according to the feed airflow W2 and the degree of the self-induced airflow W1.

In addition, in the above-explained embodiment, explained is a case where each of the ink heads 31 includes the six head blocks 35 arranged in a staggered manner. However, the present invention can be applied to a case where the nozzles 38 are aligned to form a straight line on each mono-block inkjet head 31, and the nozzles 38 aligned on the straight line cover a whole print width along the primary sweeping direction.

The present invention is not limited to the above-mentioned embodiment, and it is possible to embody the present invention by modifying its components in a range that does not depart from the scope thereof. Further, it is possible to form various kinds of inventions by appropriately combining a plurality of components disclosed in the above-mentioned embodiment. For example, it may be possible to omit several components from all of the components shown in the above-mentioned embodiment.

The present application claims the benefit of a priority under 35 U.S.C §119 to Japanese Patent Application No. 2012-206744, filed on Sep. 20, 2012, the entire content of which is incorporated herein by reference.

What is claimed is:

1. An image forming apparatus including at least one inkjet head which is disposed above a feed path of a print medium and on which a plurality of nozzles are aligned along a primary sweeping direction perpendicular to a feed direction of the print medium fed along the feed path to form images by ejecting ink droplets from the nozzles, the apparatus comprising:

a controller operable to compensate ejection timings of ink droplets to be ejected from the nozzles onto the print medium based on ejection density of the ink droplets, wherein the controller is operable to determine compensation content by additionally considering irregularity of print density of the images formed on the print medium, and to compensate the ejection timings further based on the compensation content for each of the nozzles.

2. An image forming apparatus including at least one inkjet head which is disposed above a feed path of a print medium and on which a plurality of nozzles are aligned along a primary sweeping direction perpendicular to a feed direction of the print medium fed along the feed path to form images by ejecting ink droplets from the nozzles, the apparatus comprising:

a controller operable to compensate ejection timings of ink droplets to be ejected from the nozzles onto the print medium based on ejection density of the ink droplets, wherein the ejection density is determined based on at least one of the number of nozzles aligned continuously along the primary sweeping direction that are to eject ink droplets and the number of lines aligned parallel in the feed direction onto which a single nozzle is to eject ink droplets continuously.

3. The image forming apparatus according to claim 2, wherein the ejection density is determined based on the number of ink droplets to be ejected from one of the nozzles aligned continuously or the single nozzle to an identical landing position on the print medium.

4. An image forming apparatus including at least one inkjet head which is disposed above a feed path of a print medium and on which a plurality of nozzles are aligned along a primary sweeping direction perpendicular to a feed direction of the print medium fed along the feed path to form images by ejecting ink droplets from the nozzles, the apparatus comprising:

a controller operable to compensate ejection timings of ink droplets to be ejected from the nozzles onto the print medium based on ejection density of the ink droplets, and a head gap adjustment unit that adjusts a head gap between a ejection surface of the inkjet head and a medium hold surface of a feed belt for feeding the print medium, wherein the controller is operable to determine compensation content by additionally considering the head gap adjusted by the head gap adjustment unit, and to compensate the ejection timings further based on the compensation content for each of the nozzles.

5. An image forming apparatus including at least one inkjet head which is disposed above a feed path of a print medium and on which a plurality of nozzles are aligned along a primary sweeping direction perpendicular to a feed direction of the print medium fed along the feed path to form images by ejecting ink droplets from the nozzles, the apparatus comprising:

a controller operable to compensate ejection timings of ink droplets to be ejected from the nozzles onto the print medium based on ejection density of the ink droplets, wherein the controller is operable to determine compensation content by additionally considering a feed speed of the print medium, and to compensate the ejection timings further based on the compensation content for each of the nozzles.

* * * * *